US005228610A

United States Patent [19]

Spence

[11] Patent Number: 5,228,610

[45] Date of Patent: Jul. 20, 1993

[54] WRIST SUPPORT FOR HAND-HELD DEVICES

[75] Inventor: C. Lowell Spence, Livonia, Mich.

[73] Assignee: Huck Patents, Inc., Wilmington, Del.

[21] Appl. No.: 744,764

[22] Filed: Aug. 14, 1991

[51] Int. Cl.[5] ..... A45F 5/00

[52] U.S. Cl. ..... 224/267; 29/243.522; 294/25

[58] Field of Search ..... 224/267, 218, 219, 221, 224/222; 173/30; 294/25; 30/298, 296.1; 248/118; 81/487, 489, DIG. 1; 29/243.522

[56] References Cited

U.S. PATENT DOCUMENTS

| | | | |
|---|---|---|---|
| 496,521 | 5/1893 | Low | 30/298 |
| 712,843 | 11/1902 | Paul | 173/30 |
| 1,322,775 | 11/1919 | Fallon | 30/298 |
| 4,580,435 | 4/1986 | Port et al. | 29/243.525 |
| 4,598,572 | 7/1986 | Mondello et al. | 29/243.522 |
| 4,822,087 | 4/1989 | DeCarlo | 294/25 |
| 4,852,376 | 8/1989 | Suhov | 29/243.53 |
| 4,888,846 | 12/1989 | Natale | 294/25 |
| 4,924,571 | 5/1990 | Albertson | 224/222 |
| 4,924,924 | 5/1990 | Stewart | 30/298 |
| 5,031,323 | 7/1991 | Honsa et al. | 30/298 |

*Primary Examiner*—Linda J. Sholl
*Attorney, Agent, or Firm*—Harness, Dickey & Pierce

[57] ABSTRACT

An armrest attachable to a tool to provide support for a worker's wrist while the tool is being manipulated or actuated. The armrest underlies the worker's forearm so the weight of the tool is borne partly by the worker's fingers and hand and partly by the worker's forearm. Stress on the wrist is minimized and good wrist posture is maintained. Due to the location of the armrest, the worker's forearm is located directly behind the tool handle where it can absorb kickback forces that occur as an incidental part of a lockbolt installation process.

21 Claims, 2 Drawing Sheets

WRIST SUPPORT FOR HAND-HELD DEVICES

BACKGROUND OF THE INVENTION

1. Field of the Invention

This invention relates in general to hand-held tools and in particular to a lockbolt installation tool fitted with a cantilevered support for reacting gravity and installation forces against an operator's forearm and for maintaining a healthful wrist posture.

2. Description of Prior Developments

Lockbolt installation tools are designed to connect or swage lockbolt fasteners on a pair of workpieces being secured together. Typically, the workpieces take the form of two metal sheets or a sheet and frame member in an aircraft structure. Each lockbolt fastener includes a lockbolt having a grooved shank extending through aligned holes in the workpieces. A swageable collar is positioned on a projecting portion of the lockbolt shank.

The lockbolt installation tool commonly includes a fluid-actuated piston-cylinder mechanism and an associated anvil-jaw assembly. The anvil is connected to the fluid cylinder, and the piston is connected to the jaw structure so that axial movement of the piston relative to the cylinder produces a corresponding relative movement of the jaw structure and anvil.

The jaw structure is grippingly connected to the projecting portion of the lockbolt shank, and the anvil is located in axial alignment with the collar. Axial motion of the piston within the fluid cylinder causes the jaw structure to exert a pulling force on the lockbolt and causes the anvil to exert an axial swaging force on the associated collar. The swaging action on the collar causes the collar material to be driven into the grooves in the lockbolt shank, thereby locking the lockbolt-collar assembly to the facially-engaged workpieces.

In many instances, the lockbolt installation tool is a hand-held manually-operated structure having a pistol-grip handle for manipulating and positioning the tool in operative engagement with the lockbolt fastener and collar. Usually the pistol-type handle has a depressible trigger for controlling the application of fluid pressure to the tool cylinder. When manual finger pressure is applied to the trigger, pressurized fluid is introduced into the tool cylinder thereby producing a rapid movement of the piston and a correspondingly rapid swaging of the fastener collar into the lockbolt grooves.

The lockbolt is usually designed with a breakneck groove therein so that during the collar swaging process the relatively high axial force on the lockbolt causes the protruding portion of the lockbolt to be severed from the lockbolt-collar assembly. The severing action takes place at the breakneck groove. The severed portion of the lockbolt, commonly referred to as the pintail, is forcibly ejected away from the lockbolt-collar assembly due to the pulling action of the tool jaws on the protruding portion, or pintail, of the lockbolt.

The lockbolt installation tool usually weighs several pounds. In some cases, the tool can weigh as much as 25 pounds or more. The weight of the tool can stress the worker's hand and wrist, especially after the tool has been in continuous use for an extended period of time and/or if an awkward wrist posture is maintained. Additional stress is imposed on the worker's fingers, hand, wrist and arm by reason of the rapid motion of the piston in the tool cylinder.

As the pulling action of the tool on the lockbolt severs the pintail from the lockbolt-collar assembly, the resistance to the pulling force is suddenly eliminated, such that the tool is rapidly accelerated away from the lockbolt-collar assembly. The line of action of the jaw-anvil assembly is offset from the worker's hand and wrist so that a reaction torque can be generated against the worker's hand and wrist.

SUMMARY OF THE INVENTION

The present invention relates to an arm-rest extending angularly from the handle of a hand-held tool, such as a lockbolt installation tool, for relieving stress on the worker's fingers, hand and wrist while the worker is holding the tool during the process of manipulating the tool or performing a lockbolt setting, collar-swaging, operation. The armrest includes a fabric platform adapted to underlie the worker's forearm so that the hand, wrist and forearm are stiffened against deviation, flexion or hyperextension of the wrist due, for example, to the weight of the installation tool or reaction forces generated during the pintail-severing process.

The invention is concerned broadly with a device for relieving stress on the worker's wrist and maintaining a good wrist posture, thereby preventing worker discomfort and/or possible cumulative wrist disorders. In some cases, use of the invention enhances the worker's control of the tool thereby possibly permitting manipulation of the lockbolt installation tool into tight clearance spaces or into locations which would otherwise pose an access problem for the worker.

THE DRAWINGS

DESCRIPTION OF A PREFERRED EMBODIMENT OF THE INVENTION

Figure 1:
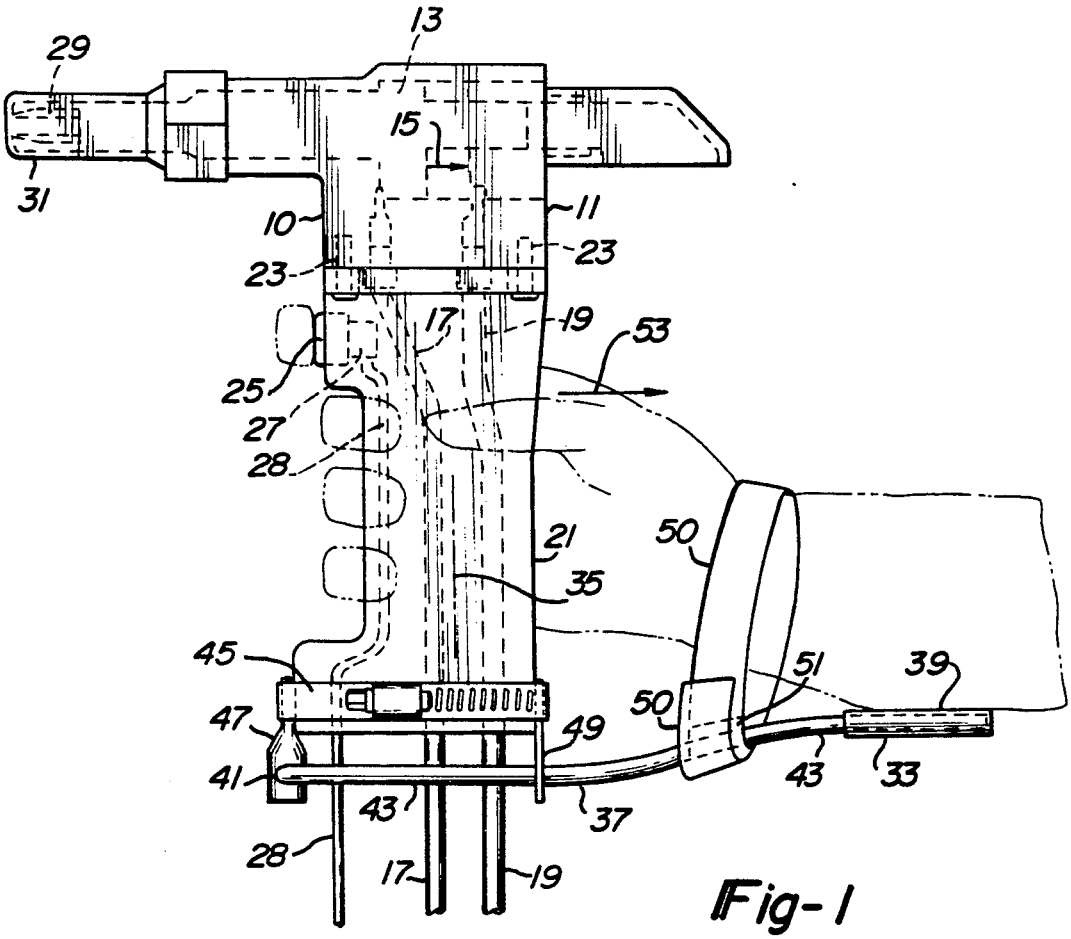
FIG. 1 is a side elevational view of a lockbolt fastener installation tool having one embodiment of the invention incorporated therein.

FIG. 1 shows, in side elevation, a lockbolt installation tool 10 that includes a housing 11 containing a slidable piston 13 having a stroke distance 15. Pressurized fluid is admitted to the left side of the piston through a flexible line or hose 17. Alternately, pressurized fluid is admitted to the right side of the piston through a flexible line 19. Usually, both hoses extend from a remote fluid power source through a hollow piston-type handle 21 that extends downwardly from housing 11 when the housing is in its FIG. 1 position. Handle 21 may be formed integrally with housing 11. As shown, the handle is a separate component bolted to housing 11 via four bolts 23, two of which are located directly behind the illustrated bolts.

Application of pressurized fluid to piston 13 is controlled by a depressible trigger 25 slidably mounted in a forward portion of handle 21. The trigger operates an electrical switch 27 that has electrical leads extending through a flexible cable 28 going back to the power source.

Piston 13 is connected to an annular jaw structure 29 that is slidably mounted in an annular tubular anvil member 31. The general arrangement is similar to that depicted in U.S. Pat. No. 4,852,376 issued to Suhov.

The jaw-anvil relationship is shown in U.S. Pat. No. 4,598,572 to Mondello, et al. The jaw structure is designed to exert a rightward pulling force on a grooved lockbolt, not shown. A leftward reaction force is thereby generated in the anvil causing the anvil to exert a leftward swaging action on a collar prepositioned on the lockbolt.

As piston 13 completes its rightward stroke, a section of the lockbolt gripped by jaw structure 29 is severed from the lockbolt-collar assembly. The sudden release of the severed pintail from the lockbolt causes the installation tool to shift rapidly in a left-to-right direction. The action is somewhat similar to the "kickback" action after firing a pistol. The present invention is concerned with an armrest construction designed, in part, to minimize stress on the worker's wrist due to the kickback action.

Figure 2:
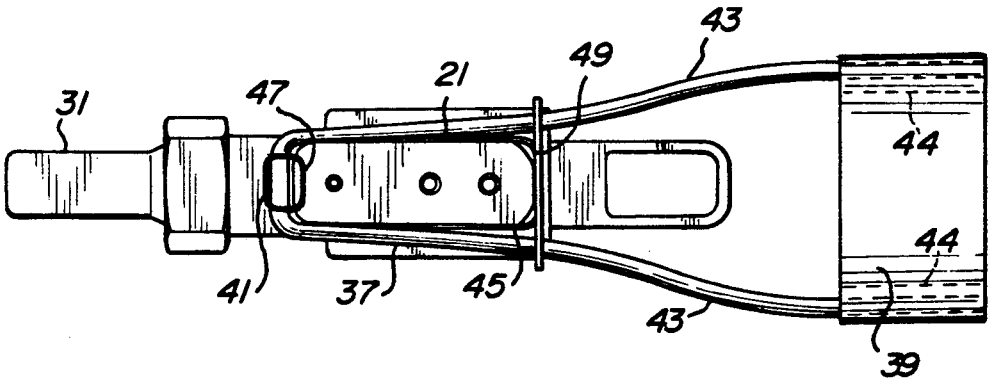
FIG. 2 is a bottom plan view of the FIG. 1 tool.

As shown in FIGS. 1 and 2, the armrest includes a platform 33 extending essentially normal to handle 21 at or near its lower butt end. When handle 21 is gripped in an upright position, as shown in FIG. 1, platform 33 will extend generally horizontally at an angle of about 90° to the handle hand-grip axis 35. This angle can be adjusted for comfort or for support based on the advice of a medical professional. Platform 33 includes a U-shaped rod bar 37 and a fabric panel or platform 39.

The rod or bar 37 may be a solid circular cross-sectioned rod element having a cross-sectional diameter of about ¼". The U-shaped rod element includes a web portion 41 and two elongated arm portions 43 extending rightwardly from the web portion across and beyond the handle 21 cross-sectional profile, as viewed in FIG. 2. Arm portions 43 constitute support bars for supporting fabric panel 39 in a horizontal position spaced rightwardly from handle 21.

Fabric panel 39 has a double wall thickness that is stitched at 44 to form two elongated pockets adapted for insertion over the right ends of arm portions 43, whereby the fabric panel can be detached from the U-shaped rod element. The right end of each pocket is closed to limit leftward insertional motion of the fabric panel onto the U-shaped element.

Panel 39 is adapted to supportably engage the worker's forearm, to thereby achieve a wrist-support action and maintain good wrist posture. Arms (bars) 43 are essentially parallel bars having their right ends spaced apart about 3 to 4", which is approximately, or slightly greater than, the width of a worker's forearm. When the worker's forearm rests against the upper surface of fabric panel 39, the panel can take a slightly concave arcuate configuration conforming to the forearm surface. The panel is relatively short in a left-to-right direction, and yet the panel has relatively large area contact with the worker's forearm due to its flexibility and its spaced support by spaced arm portions 43. This will result in minimal restriction of blood circulation.

Panel 39 is preferably spaced some distance from handle 21 to promote contact of the panel at a desired point along the worker's forearm spaced rightwardly from the worker's wrist. The left edge of panel 39 is preferably spaced from handle 21 by approximately 4".

The arm rest, defined by the U-shaped rod element and fabric panel 39, is detachably connected to handle 21 by a connection mechanism that includes a clamping band 45 and two connector elements 47 and 49. This connection can be adjusted based on advice of a medical professional or adjusted according to a user's comfort. Band 45 can be a conventional hose clamp which includes a steel band and a manual screw threadably engaged with transverse slots in the band, whereby the band can be tightened around handle 21 and connector elements 47 and 49.

Connector elements 47 and 49 may be varied as to structural detail with adjustable features. The illustrated connector element 47 is a rectangular tube having its upper end flattened for placement between band 45 and the adjacent surface of handle 21. Connector element 49 is an inverted T-shaped plate having two circular holes spaced apart to accommodate therethrough arm portions 43 of the U-shaped rod element. The upper portion of the plate is placed between band 45 and the adjacent surface of handle 21. The band can be tightened or loosened to connect or disconnect or adjust the arm rest to or from handle 21.

As an optional feature of the invention, the armrest can be equipped with a flexible strap 50 having one end 51 looped around one of the spaced arm portions 43. The free end of the strap can have a patch of fibrous adhesive material secured thereon for adhesive engagement with a mating patch on or near the anchored portion of the strap. The adherent patches can be formed of a material available under the trademark VELCRO.

Strap 50 serves primarily as a mechanism for preventing undesired separation of fabric panel 39 from the worker's forearm as well as maintaining good wrist posture. The strap also reduces dependence on finger strength to control the tool. This strap support action may be necessary especially when the tool is held in oblique or overturned positions where the forearm is not oriented above panel 39. As previously noted, strap 50 is an optional element. In many cases, strap element 50 may be undesired or unnecessary.

When panel 39 is engaged against the worker's foreman, as shown in FIG. 1, the weight of the tool is effectively borne and reacted by the hand and forearm together. A portion of the tool weight is transmitted through the armrest to exert an upward force on the forearm via fabric panel 39. When the armrest is not used, the weight of the tool is located leftwardly from the worker's wrist such that a fairly substantial cantilever load has to be borne by the wrist and supported by the hand and fingers.

The armrest advantageously positions the worker's forearm in horizontal alignment with the handgrip surfaces of handle 21. As the tool undergoes a rightward "kickback" motion, designated by arrow 53 in FIG. 1, the kickback force is oriented longitudinally through the forearm. The forearm is able to effectively absorb the kickback force without undue stress being exerted obliquely on the worker's wrist.

The presence of the armrest aligns the worker's forearm behind (to the right of) handle 21, rather than extending angularly upwardly in a plane below the handle. Without the presence of the armrest, the worker's wrist and forearm can be oblique to kickback load forces such that the wrist is subjected to stresses that can lead to human fatigue. The primary purpose of the illustrated armrest is to relieve stress on the worker's wrist when the worker's hand is in gripping engagement with handle 21.

Figure 3:
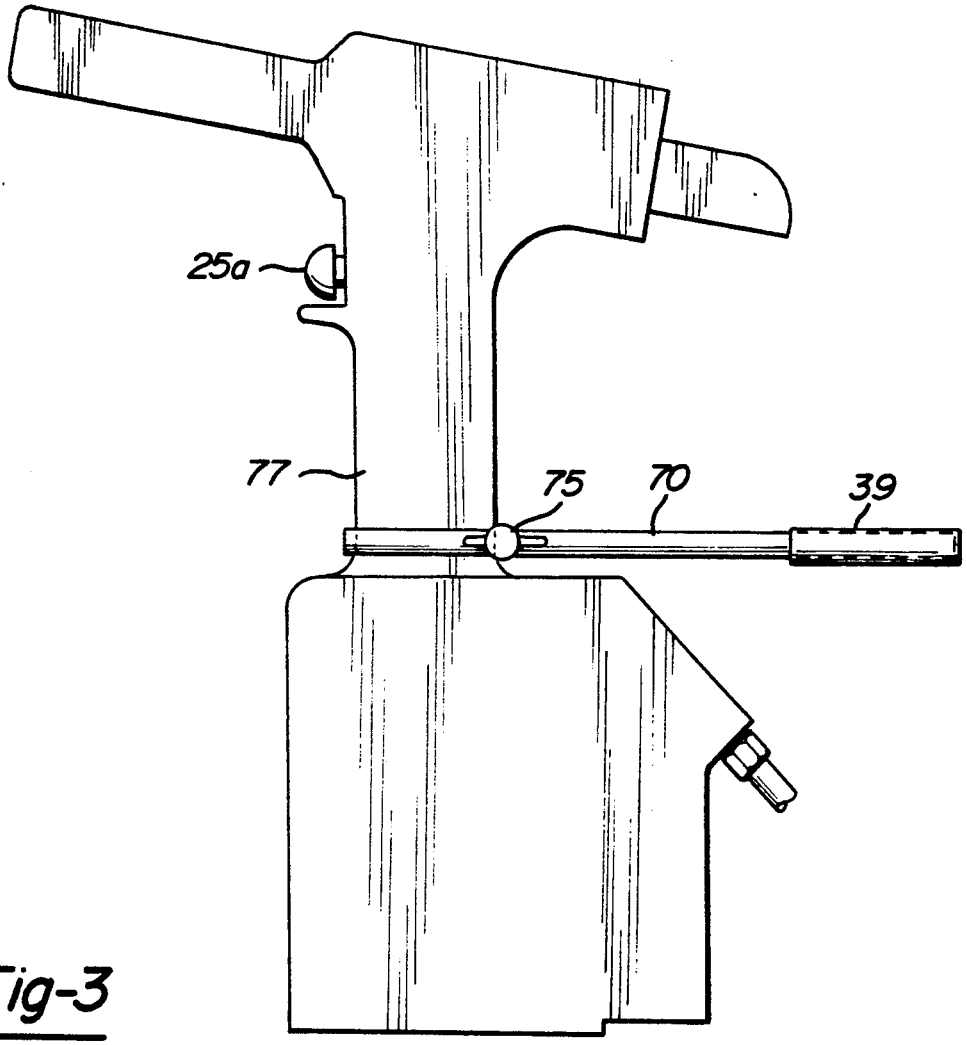
FIG. 3 is a side elevational view of a second lockbolt installation tool equipped with an armrest embodying features of the invention.
Figure 4:
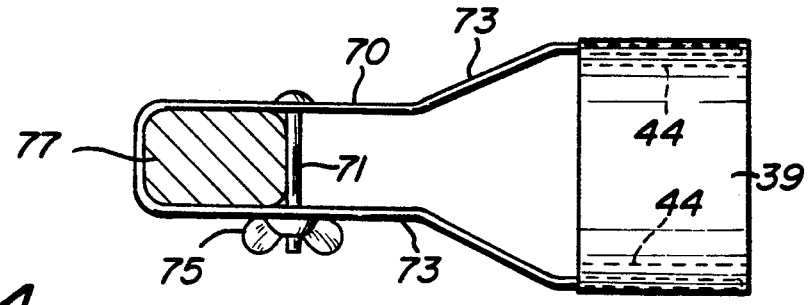
FIG. 4 is a transverse sectional view taken essentially on line 4—4 in FIG. 3.

FIGS. 3 and 4 illustrate the invention applied to a different lockbolt installation tool. Internally, the tool is constructed as shown in U.S. Pat. No. 4,580,435 issued to Port, et al. The associated armrest includes a bar or rod member 70 bent into a U-configuration, as shown in FIG. 4. The cross-section of the bar may be rectangular.

A bolt 71 extends through the spaced arm portions 73 of the U-shaped member for threaded engagement with a wing nut 75, whereby the U-shaped member is clampingly connected to handle 77 of the tool.

The armrest includes a fabric panel 39 slipped over the ends of the U-shaped member to form a platform adapted for engagement with the worker's forearm. The armrest functions in essentially the same fashion as the armrest depicted in FIGS. 1 and 2.

The drawings show two specific forms of the invention. However, it will be appreciated that the invention can be practiced in various forms and configurations. For example, the armrest can be mounted to virtually any hand-held tool having a pistol-type hand grip.

What is claimed:

1. In a fastening system for installing fasteners by a worker, the combination comprising:

a hand-held installation tool having a pistol-grip handle for manipulation and actuation of said tool and a stressrelieving device for relieving stress on the worker's wrist, hand and fingers while the worker is holding said took, said pistolgrip handle having a hand-grip axis, said stress-relieving device comprising a platform adapted to supportably engage the worker's forearm, and attaching means for attaching said platform to said tool so that said platform extends essentially normal to said hand grip axis, said platform being located in a plane passing through a lower portion of said handle so that said platform underlies the worker's forearm when the worker's hand is in gripping engagement with said handle, said platform comprises a U-shaped rod that includes a web portion located below said handle and two spaced arm portions extending from said web portion across and beyond said handle cross-sectional profile, and a panel member extending across the space between said arm portions for supporting the worker's forearm, said panel member being made of a conformable material whereby said panel member can conform to the contour of the worker's forearm, said attaching means comprises an adjustable clamping means including a band extendable around said handle at its lower end, said platform comprises a first connector element extending from said web portion alongside a first surface of said handle and a second connector element extending form said spaced arm portions alongside a second surface of said handle, said band of said clamping means being adapted to encircle said handle and said two connector elements for attaching said platform to said tool.

2. The combination of claim 1, wherein said arm portions are spaced apart approximately 3 inches.

3. The combination of claim 1, wherein said arm portions are spaced apart by a distance that is slightly greater than the width of a worker's forearm, whereby said panel member can take a concave arcuate configuration conforming to the contour of the forearm.

4. The combination of claim 1, wherein said arm portions are detachably connected to said handle at a point below the area that is to be gripped by the worker's hand.

5. In a fastening system for installing fasteners by a worker, the combination comprising:

a hand-held installation tool having a pistol-grip handle for manipulation and actuation of said tool by th worker and a stress relieving device for relieving stress on the worker's wrist, hand and fingers while the worker is holding said tool, said pistol-grip handle having a hand-grip axis, said stress-relieving device comprising a platform adapted to supportably engage the worker's forearm, and attaching means for attaching said platform to said tool so that said platform extends essentially normal to said hand grip axis, said platform being located in a plane passing through a lower portion of said handle so that said platform underlies the worker's forearm when the worker's hand is in gripping engagement with said handle, said platform comprises two spaced, essentially parallel bars and a panel member extending between said bars, said panel member being made of a conformable material whereby said panel member can conform to the contour of the worker's forearm, said panel member having two spaced elongated pockets insertable over said spaced bars, whereby said panel member can be detached from said bars.

6. The combination of claim 5, wherein said attaching means comprises an adjustable clamping means including a band extendable around said handle at its lower end.

7. The combination of claim 5, wherein said panel member is spaced from said handle by approximately 4 inches.

8. The combination of claim 5, wherein said bars are spaced apart approximately 3 inches.

9. The combination of claim 5, wherein said bars are spaced apart by a distance slightly greater than the width of a worker's forearm, whereby said panel member can conform to the contour of the forearm.

10. A device for relieving stress on a worker's wrist, hand and fingers while the worker is holding a tool, wherein the tool has a pistol-grip handle having a hand-grip axis; said stress-relieving device comprising a platform adapted to supportably engage the worker's forearm; and means for attaching said platform to the tool so that the platform extends essentially normal to the hand grip axis; said platform being located in a plane passing through a lower portion of the handle so that the platform underlies the worker's forearm when the worker's hand is in gripping engagement with the handle; said platform comprises two spaced, essentially parallel bars and a fabric panel extending between said bars, wherein the fabric panel has two spaced elongated pockets insertable over the spaced bars, whereby the panel can be detached from the bars.

11. The device of claim 10, wherein said attaching means comprises an adjustable clamping means including a band extendable around the handle at its lower end.

12. The device of claim 11, wherein said platform comprises a U-shaped rod that includes a web portion located below the handle and two spaced arm portions extending from said web portion across and beyond the handle cross-section profile, and a fabric panel extending across the space between said arm portions.

13. A device for relieving stress on a worker's wrist, hand and fingers while the worker is holding a tool, wherein the tool has a pistol-grip handle having a hand-grip axis; said stress-relieving device comprising a platform adapted to supportably engage the worker's forearm; and means for attaching said platform to the tool so that the platform extends essentially normal to the hand grip axis; said platform being located in a plane passing through a lower portion of the handle so that the platform underlies the worker's forearm when the worker's hand is in gripping engagement with the handle; wherein said platform comprises a U-shaped rod that includes a web portion located below the handle and two spaced arm portions extending from said web portion across and beyond the handle cross-sectional profile, and a fabric panel extending across the space between said arm portions; wherein said attaching means comprises an adjustable clamping means including a band extendable around the handle at its lower end; said platform comprises a first connector element extending from said web portion alongside a first surface of the handle and a second connector element extending from said spaced arm portions alongside a second surface of the handle; said band of said clamping means being adapted to encircle the handle and the two connector elements for attaching said platform to the tool.

14. The device of claim 13 in which the tool is a lockbolt installation type tool.

15. The device of claim 13, with said fabric panel extending between said bars and providing a concave arcuate configuration for supporting and conforming to the worker's forearm surface.

16. The device of claim 13, with said panel member being conformable to the worker's forearm surface and spaced from the tool handle by approximately 4 inches.

17. The device of claim 16, wherein said arm portions are spaced apart approximately 3 inches.

18. The device of claim 16, wherein said arm portions are spaced apart by a distance slightly greater than the width of a worker's forearm, whereby said panel member can conform to the contour of the forearm.

19. A device for relieving stress on a worker's wrist, hand and fingers while the worker is holding a tool, wherein the tool has a pistol-grip handle having a handgrip axis, said stress-relieving device comprising a platform adapted to supportably engage the worker's forearm, and means for attaching said platform to the tool so that the platform extends essentially normal to the hand grip axis, said platform being located in a plane passing through a lower portion of the handle so that the platform underlies the worker's forearm when the worker's hand is in gripping engagement with the handle, said platform comprises two spaced, essentially parallel bars and a panel member extending between said bars, said panel member being made of a conformable material whereby said panel member can conform to the contour of the worker's forearm, said panel member having two spaced elongated pockets insertable over said spaced bars, whereby said panel member can be detached from said bars.

20. The device of claim 19, wherein said attaching means comprises an adjustable clamping means including a band extendable around the handle at its lower end.

21. A device for relieving stress on a worker's wrist, hand and fingers while the worker is holding a tool, wherein the tool has a pistol-grip handle having a handgrip axis, said stress-relieving device comprising a platform adapted to supportably engage the worker's forearm, and means for attaching said platform to the tool so that the platform extends essentially normal to the hand grip axis, said platform being located in a plane passing through a lower portion of the handle so that the platform underlies the worker's forearm when the worker's hand is in gripping engagement with the handle, wherein said platform comprises a U-shaped rod that includes a web portion located below the handle and two spaced arm portions extending from said web portion across and beyond the handle cross-sectional profile, and a panel member extending across the space between said arm portions for supporting the worker's forearm, said panel member being made of a conformable material whereby said panel member can conform to the contour of the worker's forearm, said attaching means comprises an adjustable clamping means including a band extendable around then handle at its lower end, said platform comprises a first connector element extending form said web portion alongside a first surface of the handle and a second connector element extending from said spaced arm portions alongside a second surface of the handle, said band of said clamping means being adapted to encircle the handle and the two connector elements for attaching said platform to the tool.

* * * * *

UNITED STATES PATENT AND TRADEMARK OFFICE

CERTIFICATE OF CORRECTION

PATENT NO. : 5,228,610

DATED : July 20, 1993

INVENTOR(S) : C. Lowell Spence

It is certified that error appears in the above-identified patent and that said Letters Patent is hereby corrected as shown below:

Col. 5, line 22, Claim 1, delete "took" and substitute therefor --tool--.
Col. 5, line 67, Claim 5, delete "th" and substitute therefor --the--.

Signed and Sealed this

Twenty-ninth Day of March, 1994

*Attest:*

*Attesting Officer*

BRUCE LEHMAN

*Commissioner of Patents and Trademarks*